US009118998B2

(12) United States Patent
Lin

(10) Patent No.: US 9,118,998 B2
(45) Date of Patent: Aug. 25, 2015

(54) MULTIPLE SOUND CHANNELS SPEAKER

(71) Applicant: GIGA-BYTE TECHNOLOGY CO., LTD., New Taipei (TW)

(72) Inventor: Yin Yu Lin, New Taipei (TW)

(73) Assignee: GIGA-BYTE TECHNOLOGY CO., LTD., New Taipei (TW)

( * ) Notice: Subject to any disclaimer, the term of this patent is extended or adjusted under 35 U.S.C. 154(b) by 312 days.

(21) Appl. No.: 13/761,166

(22) Filed: Feb. 7, 2013

(65) Prior Publication Data

US 2014/0219481 A1 Aug. 7, 2014

(51) Int. Cl.
*H04R 3/12* (2006.01)

(52) U.S. Cl.
CPC ..... *H04R 3/12* (2013.01)

(58) Field of Classification Search
CPC ..... H04R 3/12
USPC ..... 381/1, 17, 23, 81, 300, 104, 370; 463/35; 700/94; 704/503; 725/81
See application file for complete search history.

(56) References Cited

U.S. PATENT DOCUMENTS

| | | | | |
|---|---|---|---|---|
| 4,151,470 | A | 4/1979 | Sato | |
| 6,128,009 | A * | 10/2000 | Ohkura et al. | 725/46 |
| 6,608,640 | B1 * | 8/2003 | Nagahara et al. | 715/848 |
| 7,212,872 | B1 * | 5/2007 | Smith et al. | 700/94 |
| 7,563,168 | B2 * | 7/2009 | Jahnke | 463/35 |
| 7,647,229 | B2 * | 1/2010 | Ojala et al. | 704/503 |
| 7,840,983 | B1 * | 11/2010 | Feldman et al. | 725/81 |
| 7,940,938 | B2 * | 5/2011 | Miki et al. | 381/81 |
| 8,213,630 | B2 * | 7/2012 | Yoshizawa et al. | 381/81 |
| 8,861,769 | B2 * | 10/2014 | Lin | 381/370 |
| 2003/0031333 | A1 | 2/2003 | Cohen et al. | |
| 2008/0247570 | A1 * | 10/2008 | Lin et al. | 381/104 |
| 2010/0226498 | A1 * | 9/2010 | Kino et al. | 381/1 |
| 2012/0093323 | A1 * | 4/2012 | Lee et al. | 381/23 |
| 2012/0314872 | A1 * | 12/2012 | Tan et al. | 381/17 |
| 2014/0219481 | A1 * | 8/2014 | Lin | 381/300 |

FOREIGN PATENT DOCUMENTS

| | | | |
|---|---|---|---|
| JP | H11-4500 | A | 1/1999 |
| JP | 2006033077 | A | 2/2006 |
| JP | 2007-270469 | A | 10/2007 |
| TW | 2012256692 | A | 6/2012 |

* cited by examiner

*Primary Examiner* — Gerald Gauthier
(74) *Attorney, Agent, or Firm* — Chun-Ming Shih; HDLS IPR SERVICES

(57) ABSTRACT

A multiple sound channels speaker is disclosed herein and includes a first speaker, at least one second speaker, a sensing switch and an audio decoder. The second speaker is adjacent to the first speaker, and the sensing switch is disposed between the first speaker and the second speaker. The audio decoder is electrically connected to the sensing switch. When the second speaker and the first speaker are separated, the sensing switch outputs a signal to the audio decoder and the sound channels are switched.

10 Claims, 4 Drawing Sheets

MULTIPLE SOUND CHANNELS SPEAKER

BACKGROUND

1. Technical Field

This disclosure relates to a multiple sound channels speaker, and more particularly to a multiple sound channels speaker which switches different sound channels by no means of any manual switch.

2. Description of the Related Art

Nowadays, due to progress of computer technology and internet, much audio and video broadcasting is realized on the computer via the internet. Therefore, many peripheral multimedia apparatuses are highly needed, and more and more high-level speakers are sold, which are 2.0, 5.1 or 7.1 sound channels speakers. Nevertheless, the performances of such 5.1 or 7.1 sound channels speakers are not always needed in any time. That is, in case of phoning internet call, it merely needs single sound channel or dual sound channels speakers, but in case of watching TV/movie or playing electronic games, the single sound channel or dual sound channels speakers should be switched to 5.1 or 7.1 sound channels speakers correspondingly. Even though many speakers capable of switching different sound channels are sold, but a press button is still needed specially to control the different sound channels switching.

However, the different sound channels are unable to be switched rapidly by utilizing the press button. Therefore, this disclosure discloses a multiple sound channels speaker which switches different sound channels rapidly and instinct to overcome the prior art defect.

SUMMARY

In view of the foregoing prior art defect, the objective of this disclosure is to provide a multiple sound channels speaker capable of switching different sound channels without any press button. Further, another objective of this disclosure is to provide a multiple sound channels speaker capable of switching different sound channels rapidly and instinct Accordingly, the multiple sound channels speaker provided comprises a first speaker, a second speaker, a sensing switch and an audio decoder, wherein the second speaker is adjacent to the first speaker, the sensing switch is disposed between the first speaker and the second speaker, and the audio decoder is electrically connected to the sensing switch. When the first speaker is separated from the second speaker, the sensing switch outputs a signal to the audio decoder, so as to switch sound channels correspondingly.

Furthermore, the multiple sound channels speaker provided further comprises a first speaker, a second speaker, a third speaker, at least two sensing switches and an audio decoder, wherein the second speaker is adjacent to the first speaker, the third speaker is adjacent to the second speaker, the sensing switches are disposed between the first speaker and the second speaker, and between the second speaker and the third speaker respectively, and the audio decoder is electrically connected to the sensing switch. When the first speaker is separated from the second speaker, or when the second speaker is separated from the third speaker, the sensing switch outputs a signal to the audio decoder, so as to switch sound channels correspondingly.

A detailed description is given in the following embodiments with reference to the accompanying drawings.

BRIEF DESCRIPTION OF THE DRAWINGS

This disclosure can be more fully understood by referring to the following detailed description and examples with references made to the accompanying drawings, wherein.

DETAILED DESCRIPTION OF THE INVENTION

The following description is of the best-contemplated mode of carrying out this disclosure. This description is made for the purpose of illustrating the general principles of this disclosure and should not be taken in a limiting sense. The scope of this disclosure is best determined by reference to the appended claims.

Figure 1A:
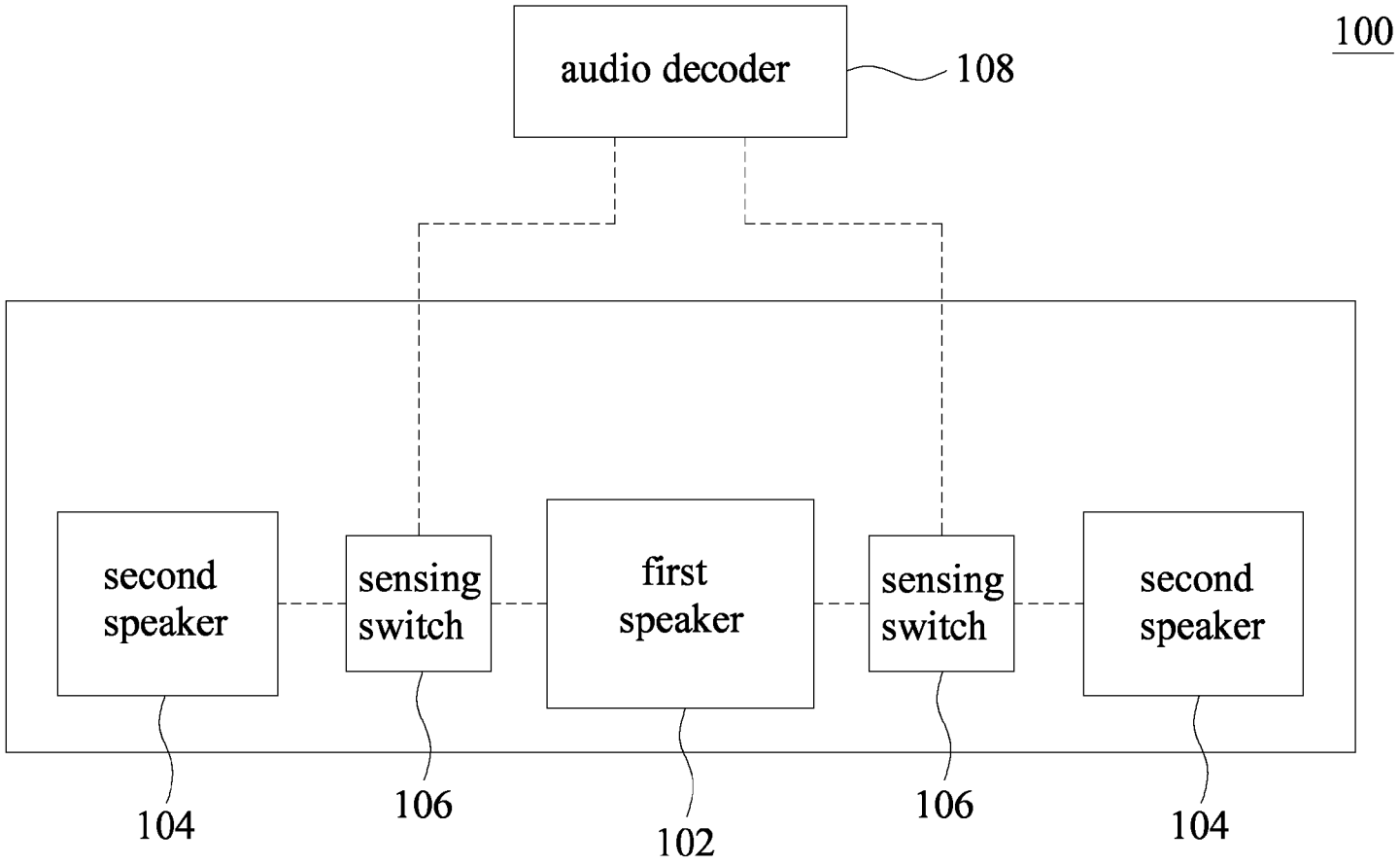
FIGS. 1*a* and 1*b* is the schematic diagram of a preferred embodiment of a multiple sound channels speaker according to this disclosure.
Figure 1B:
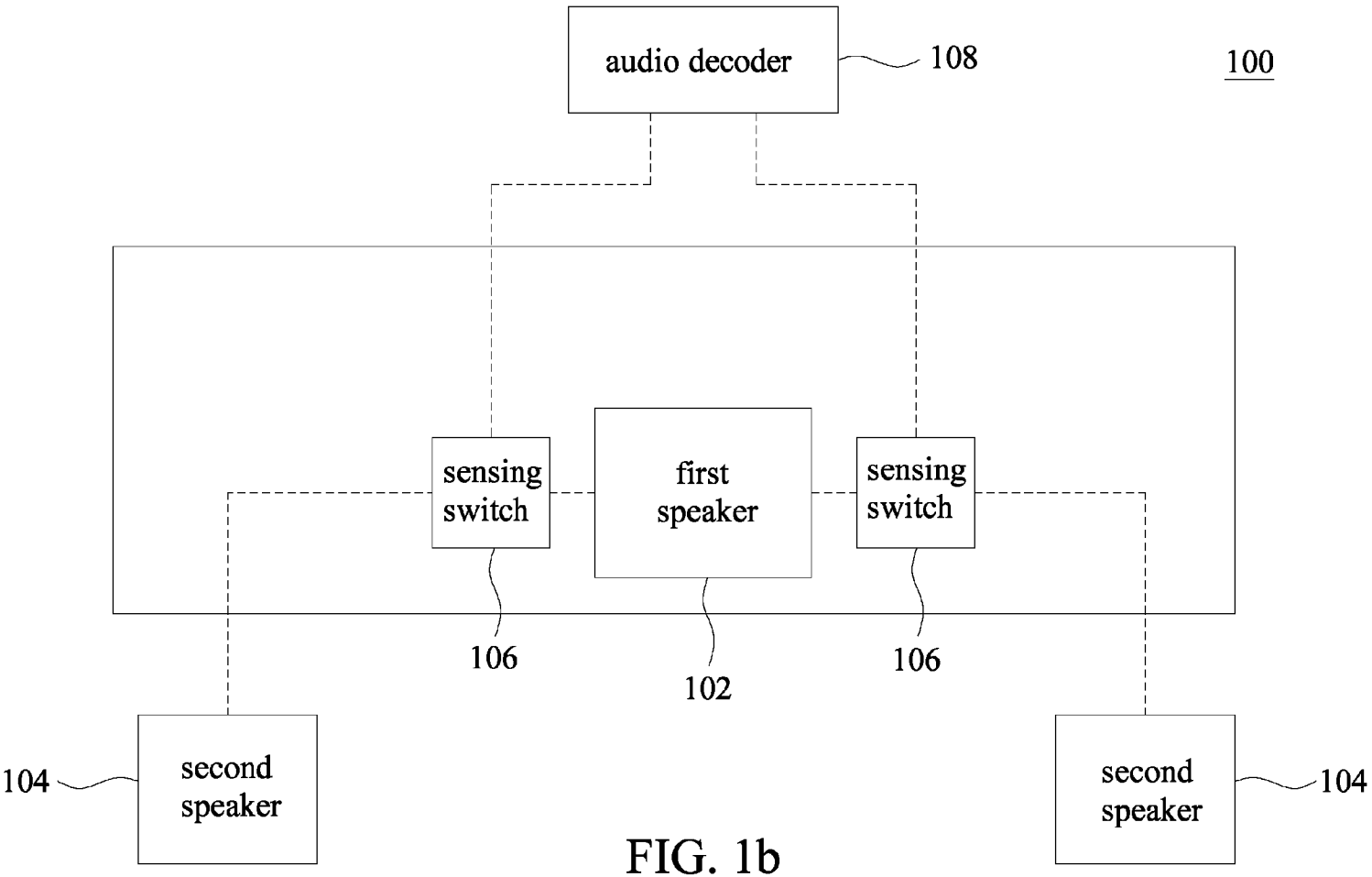

FIG. 1*a* is the schematic diagram of a preferred embodiment of a multiple sound channels speaker according to this disclosure. As shown in FIG. 1*a*, the multiple sound channels speaker 100 is an integrally multiple sound channels speaker 100, which essentially comprises a first speaker 102, at least one second speaker 104, a plurality of sensing switches 106 and an audio decoder 108. The first speaker 102 is adjacent to the second speaker 104, and the first speaker 102 is wired connected to the second speaker 104, or the first speaker 102 is wireless transmitted to the second speaker 104. The sensing switch 106 is disposed between the first speaker 102 and the second speaker 104, wherein the sensing switch 106 is a mechanical trigger device or a touched sensing device, and to be emphasized is that this disclosure is not limited to the disclosed embodiments. The audio decoder (Audio Codec IC) 108, electrically connected to the sensing switch 106, is used for judging switching condition of the sound channels by means of receiving an output signal form the sensing switch 106. Generally, the first speaker 102 and the second speaker 104 are connected together to form a single sound channel or dual sound channels speaker. As shown in FIG. 1*b*, when the first speaker 102 is separated from the second speaker 104, the sensing switch 106, disposed between the first speaker 102 and the second speaker 104, outputs a signal to the audio decoder 108. Therefore, the audio decoder 108 switches the multiple sound channels speaker 100 from a single sound channel or dual sound channels speaker to a 2.1 sound channels speaker, and switches the two second speakers 104 to left and right sound channels speakers respectively, and further switches the first speaker 102 to a low-sounding speaker.

Figure 2A:
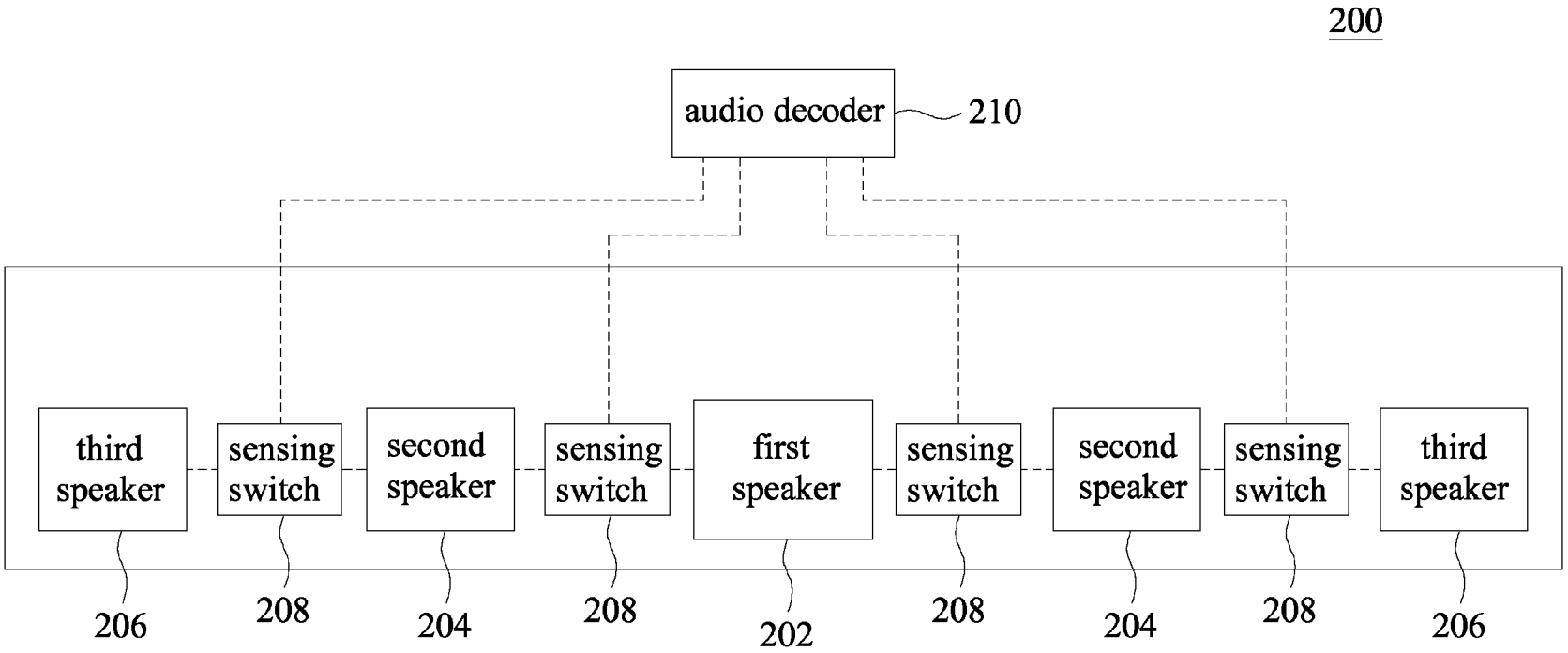
FIGS. 2*a* and 2*b* is the schematic diagram of another embodiment of a multiple sound channels speaker according to this disclosure.

FIG. 2*a* is the schematic diagram of another embodiment of a multiple sound channels speaker according to this disclosure. As shown in FIG. 2A, the multiple sound channels speaker 200 essentially comprises at least one first speaker 202, at least one second speaker 204, at least one third speaker 206, a plurality of sensing switches 208 and an audio decoder 210. The first speaker 202 is adjacent to the second speaker 204, and the second speaker 204 is adjacent to the third speaker 206, hence the first speaker 202, the second speaker 204 and the third speaker 206 are wired connected or wireless transmitted to each other. For instance, the wireless transmitted technologies include but not limited to infrared wireless transmission or blue tooth wireless transmission. The sensing switches 208 are disposed between the first speaker 202 and the second speaker 204, and between the second speaker 204 and the third speaker 206 respectively, wherein the sensing switches 208 are mechanical trigger devices or touched sensing devices, and to be emphasized is that this disclosure is not limited to the disclosed embodiments. The audio decoder 210, electrically connected to the sensing switches 208, is used for judging switching condition of the sound channels by means of receiving output signals form the sensing switches 208. Generally, the first speaker 202, the second speaker 204 and the third speaker 206 are connected together. Besides, when the second speaker 204 is separated from the third speaker 206, the sensing switch 208, disposed between the second speaker 204 and the third speaker 206, outputs a signal to the audio decoder 210. Therefore, the audio decoder 210 switches the multiple sound channels speaker 200 from a single sound channel or dual sound channels speaker to a 2.1 sound channels speaker, and switches two third speakers 206 to left and right sound channels speakers respectively, and further switches the first speaker 202 and second speaker 204 to low-sounding speakers.

Figure 2B:
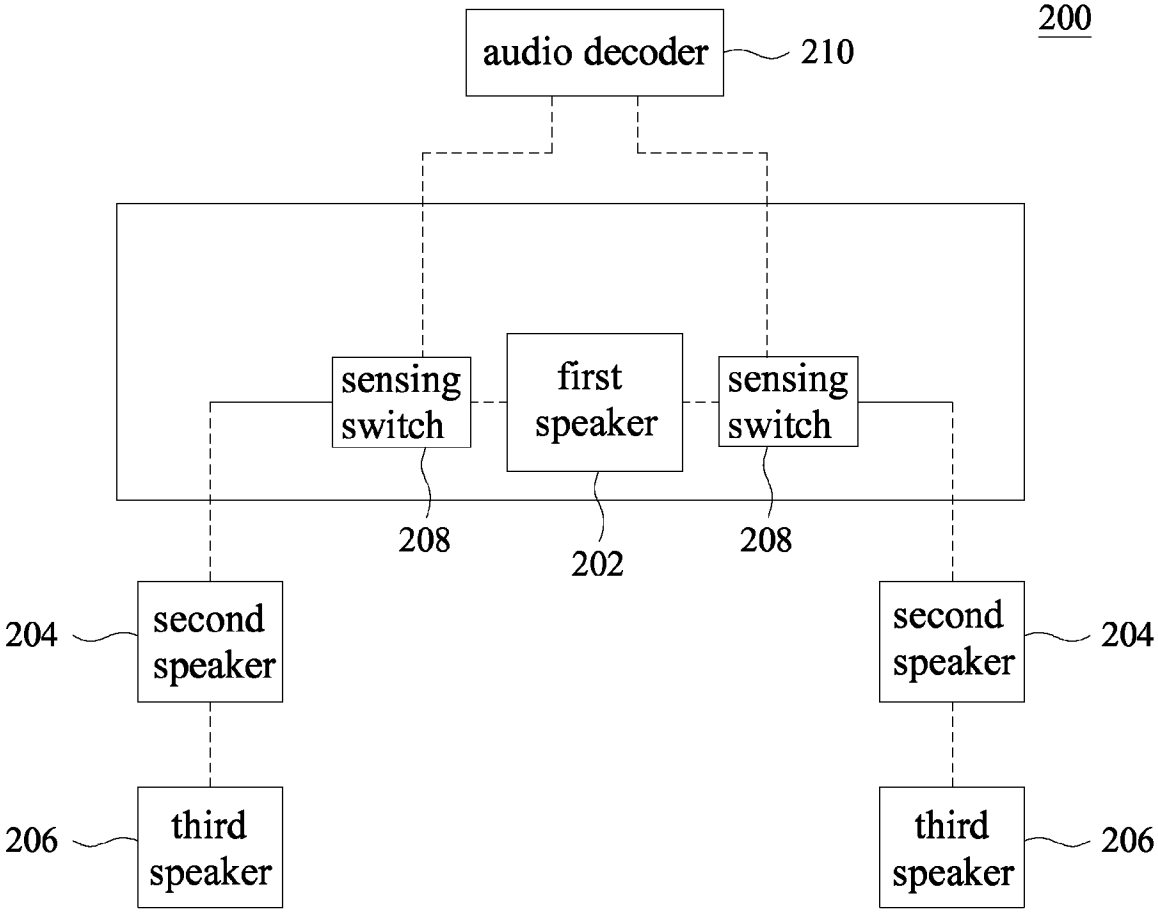

In addition, as shown in FIG. 2B, when the second speaker 204 is separated from the first speaker 202, the sensing switch 208, disposed between the first speaker 202 and the second speaker 204, also outputs a signal to the audio decoder 210. Thus, the multiple sound channels speaker 200 switches from a 2.1 to 5.0 sound channels speaker, wherein the first speaker 202 is the main sound channel speaker, the second speakers 204 are the left-front and right-front sound channels speakers, and the third speakers 206 are the left-rear and right-rear sound channels speakers correspondingly. Accordingly, when the above mentioned speakers are separated from each other, the sensing switches 208, disposed among those speakers, drive the audio decoder 210 to switch sound channels correspondingly, so as to use no any press button. In detail, the above mentioned embodiments of this disclosure does not limit to merely switch a single sound channel speaker to a 2.1 or 5.0 sound channels speaker, said single sound channel or dual sound channels speakers can be further switched to 2.0, 5.0 or 7.1 sound channels speakers by adding or removing the speakers correspondingly. On the other hand, the switching sequence of those speakers is to separate the first speaker 202 from the second speaker 204 first, then separate the second speaker 204 from the third speaker 206, such that the purpose of switching a dual sound channels speaker to a multiple sound channels speaker could be achieved on the same way.

In sum, one of the objectives of this disclosure can be achieved to switch sound channels directly and instinct when said speakers are separated from each other by means of the sensing switches, which is convenient and efficient because it is not necessary for the user to switch the sound channels by utilizing a manual switch.

While the invention has been described by way of example and in terms of the preferred embodiments, it is to be understood that the invention is not limited to the disclosed embodiments. To the contrary, it is intended to cover various modifications and similar arrangements. Therefore, the scope of the appended claims should be accorded the broadest interpretation so as to encompass all such modifications and similar arrangements.

What is claimed is:

1. A multiple sound channels speaker, comprising:

a first speaker;

at least one second speaker, selectively disposed adjacent to the first speaker or separated from the first speaker;

a sensing switch disposed between the first speaker and the second speaker, for determining whether the second speaker is separated from the first speaker; and an audio decoder electrically connected to the sensing switch, wherein when the second speaker is disposed adjacent to the first speaker, the audio decoder switches the first speaker and the second speaker into a single sound channel, and; when the sensing switch determines that the first speaker is separated from the second speaker, the sensing switch outputs a signal to the audio decoder, so as to switch the first speaker into a first sound channel and the second speaker into a second channel.

2. The multiple sound channels speaker as claimed in claim 1, further comprising at least one third speaker, wherein the third speaker is adjacent to the second speaker.

3. The multiple sound channels speaker as claimed in claim 1, wherein the first speaker is wired connected to the second speaker.

4. The multiple sound channels speaker as claimed in claim 1, wherein the first speaker is wireless transmitted to the second speaker.

5. The multiple sound channels speaker as claimed in claim 1, wherein the sensing switch is a mechanical trigger device.

6. The multiple sound channels speaker as claimed in claim 1, wherein the sensing switch is a touched sensing device.

7. A multiple sound channels speaker, comprising:

at least one first speaker;

at least one second speaker, selectively disposed adjacent to the first speaker or separated from the first speaker;

at least one third speaker, selectively disposed adjacent to the second speaker or separated from the second speaker;

at least two sensing switches disposed between the first speaker and the second speaker, and between the second speaker and the third speaker respectively, the sensing switch disposed between the first speaker and the second speaker determining whether the second speaker is separated from the first speaker and the sensing switch disposed between the second speaker and the third speaker determining whether the third speaker is separated from the second speaker; and an audio decoder electrically connected to the sensing switch, wherein when the first speaker, the second speaker and the third speaker are disposed together, the sensing switch outputs a first signal to the audio decoder, so as to switch the first speaker and the second speaker into a single sound channel;

when the sensing switch disposed between the second speaker and the third speaker determines that the third speaker is separated from the second speaker, the sensing switch outputs a second signal to the audio decoder, so as to switch the first speaker and the second speaker into a first sound channel and to switch the third speaker into a second sound channel;

when the sensing switch disposed between the second speaker and the third speaker determines that the third speaker is separated from the second speaker while the sensing switch disposed between the first speaker and the second speaker determines that the second speaker is separated from the first speaker, the sensing switches outputs the first signal and a second signal to the audio decoder, so as to switch the first speaker into a third sound channel, to switch the second speaker into a fourth sound channel, and to switch the third speaker into a fifth sound channel.

8. The multiple sound channels speaker as claimed in claim 7, wherein the first speaker, the second speaker and the third speaker are wired connected or wireless transmitted to each other.

9. The multiple sound channels speaker as claimed in claim 7, wherein the sensing switch is a mechanical trigger device.

10. The multiple sound channels speaker as claimed in claim 7, wherein the sensing switch is a touched sensing device.

* * * * *